US006449219B1

(12) United States Patent
Hepp et al.

(10) Patent No.: US 6,449,219 B1
(45) Date of Patent: Sep. 10, 2002

(54) TIME SENSING DEVICE

(76) Inventors: Volker Hepp, Haydnstrasse 51, D-69198 Schriesheim; Joe D. Pradelski, Neufahrner Strasse 17, D-81679, München, both of (DE); Boris Glass, Chrogasse 22, CH-8001 Zurich (CH)

( * ) Notice: Subject to any disclaimer, the term of this patent is extended or adjusted under 35 U.S.C. 154(b) by 0 days.

(21) Appl. No.: 09/530,066

(22) PCT Filed: Jul. 4, 1998

(86) PCT No.: PCT/DE98/01859

§ 371 (c)(1),
(2), (4) Date: Apr. 21, 2000

(87) PCT Pub. No.: WO99/21064

PCT Pub. Date: Apr. 29, 1999

(30) Foreign Application Priority Data

Oct. 21, 1997 (DE) ..... 197 47 879

(51) Int. Cl.[7] ..... G04B 19/26; G04B 19/24; G04C 19/00

(52) U.S. Cl. ..... 368/16; 368/29; 368/82; 368/239

(58) Field of Search ..... 368/15–19, 21, 368/28–30, 82–84, 223, 239

(56) References Cited

U.S. PATENT DOCUMENTS

| | | | | | |
|---|---|---|---|---|---|
| 4,397,565 | A | | 8/1983 | Ota | |
| 5,023,849 | A | * | 6/1991 | Vaucher | 368/15 |
| 5,124,959 | A | | 6/1992 | Yamazaki et al. | |
| 5,455,808 | A | | 10/1995 | Grupp et al. | |
| 5,508,979 | A | * | 4/1996 | Eisenegger | 368/15 |
| 5,898,645 | A | * | 4/1999 | Sugiyama | 368/82 |

FOREIGN PATENT DOCUMENTS

| | | |
|---|---|---|
| CH | 589887 | 7/1977 |
| CH | 628 042 A3 | 12/1981 |
| EP | 0 274 172 A1 | 7/1988 |
| EP | 0 539 333 A2 | 4/1993 |
| FR | 2 583 895 A1 | 12/1986 |
| JP | 63179281 | 7/1988 |

* cited by examiner

*Primary Examiner*—Vit Miska
(74) *Attorney, Agent, or Firm*—Alston & Bird LLP

(57) ABSTRACT

A timepiece with a computer based clock (2), in which time is represented on a display (1) in an analog fashion, constructed such that in order to enlarge the scope of time information on the display (1) additional information relating to the progress of time can be shown in a preferably continuous, i.e. dynamic way.

20 Claims, 3 Drawing Sheets

TIME SENSING DEVICE

BACKGROUND OF THE INVENTION

1. Field of the Invention

The invention refers to a timepiece with a computer based clock, in which time is represented in an analog fashion on an optoelectronic display.

2. Description of Related Art

Timepieces in various different forms are known. For example, the invention of the mechanical clock in the Middle Ages is closely coupled to the invention of a circular dial on which hours and minutes are displayed with use of two hands in an analog manner.

A digital representation of time is also known, however, this form was not generally accepted for daily use, in particular, because this representation lacks the visual information of time and duration with respect to the full hour. The circular dial is a natural representation of a cycle of 12 hours and was developed from the semi-circular representation of the hours in a sundial. In the development process of the clock towards the modern clock as a piece of art or towards multifunctional timepieces, a multitude of new functions have been built into the clock, thereby necessitating new and costly controls and additional dials.

High quality Swiss chronometers became masterpieces in the mechanical, technical and artistic aspects. The multifunctional clock, mainly oriented towards applications in sports, has also been coupled to keyboards and pocket computers. Also it is well known to combine traditional clocks, in particular digital time displaying timepieces, with additional devices like, e.g. pulsemeters, radios or even wireless receivers.

In the timepieces or clocks heretofore known, the dial itself is static, since it embodies fixed reference marks. This is true also for clocks exhibiting refined graphical, fashionable or artful pictorial representations. If a traditional analog clock is required to transfer further information to the user—in addition to the classical representation of time—a quite substantial mechanical refinement is needed. Such clocks are usually very expensive and out of reach for the average consumer.

SUMMARY OF THE INVENTION

A basic object of the present invention is therefore the creation of a computer based timepiece as described above with improved functionality on the one hand and with improved acceptance in the population on the other hand by keeping the price for such a device in reasonable limits.

The inventive object as stated above is solved by the characteristics of claim 1 for the proposed timepiece. According to claim 1 the device as defined in the first paragraph is structured in a way as to represent on the display additional information with respect to the progress of time in preferably continuous variation, i.e. dynamically.

According to the invention, the way of displaying hours and possibly minutes in an analog mode is kept unchanged. However, this analog representation takes place on an optoelectronic display in a dynamic way. In addition to the representation of time of day on the optoelectronic display further information concerning the progress of time is displayed, also in a dynamic way. Hence, the representation on the display is to be understood as playing a movie in slow motion. This dynamic representation includes the timepiece and the time of day on the one hand and additional information relevant for the progress of time on the other hand. Both representations are generated by an animation program.

For the representation of time, a preferably circular dial with hand may be depicted in a continuously varying way. It is important for the invention that the traditional circular or possibly oval or rectangular form of the dial be maintained, thereby using the familiar analog way of representation. In contrast to a traditional mechanical clock, the dial with one or several hands is depicted in a continuously varying way. It is noteworthy here, that the representation of time may be realized in any cartoon-like type of animation. E.g. a backward running clock may be shown in a playful representation. In summary, any imaginable possibility of realizing a "real" or "falsified" representation of time is possible similar to a cartoon.

The additional information may be shown on the outside of the dial, so to speak, at the rim. The position of this information may be assigned to the individual digits.

In case of a rectangular form of the display, the information may be assigned to regions at the corners or rims of the screen. This information on the course of time may be of a symbolic nature.

In the same way, it is possible that the information be displayed inside the dial. In choosing such a lay-out care must be taken that pictograms in radial direction are to be avoided, since they would overlay with the hand or hands at least at times, wherein the hand or hands are not recognizable any more.

To be specific, the information may include the representation of the progress of day, the depiction of a horizon with sky positioned above it, or the representation of sun, moon and possibly clouds. More precisely, the information in addition to the 12 hour-dial could include the actual position of the sun, in order to obtain exact information whether the time of day is morning, afternoon or evening.

In the same way the information may include the realtime position and phase of the moon, whereby in particular sleepwalkers get relevant information. Also the information may include the actual position of preferably selected stars or possibly constellations, where the constellations may be selected via software in actual cases.

The symbolic representation of the realtime season is information of particular importance. In this case one can select a symbolic changing in the course of the year in a very refined manner. It is stressed here, that this symbolism may be of any type which is capable of representing the course of the season appropriately. For this purpose the symbolism of a tree or the symbolism of a preferably circular treetop is very suitable, since a tree allows unique identification of the four seasons due to its state which is specific for the particular season.

In case a treetop is chosen for representing the symbolism of the seasons, the treetop could in a very advantageous way form the dial of the analog clock simultaneously, as also for the clock the circular form of the dial is of great importance. The dial could literally be incorporated or integrated into the rim of the treetop such that with this symbolism a unique form of the animation program and of the continuous gradual changes shown on the display is obtained.

Furthermore and advantageously, the tree or treetop can be associated with the representation of objects which are typical for a particular season. One can attribute light-green to dark-green leaves, apples, Christmas decorations etc. to the treetop according to the season to be depicted. The treetop as well as trunk might be covered with snow in winter, thereby again symbolizing the cold season or the actual weather conditions.

Furthermore and advantageously, the information relevant for the course of time can be operated by remote control, e.g. the time can be controlled and synchronized by a DCF signal. This is relevant for the actual time of day on the one hand and for further information to be displayed according to the preceding explanation.

The information referring to the course of time is advantageously controlled via a fully automatic position recognization system, preferably via GPS in a position dependent way. Hereby, for example, the position of the device is recognized by use of GPS and, with knowledge of the absolute time at a specific location, the local time may be determined, hence also day, night or season, as well as the local position of the constellations, the phase of the moon, etc. may be derived and may be represented in an unique fashion. Hereby the correlation of position of the device and data relevant to the course of time is precisely maintained.

The additional position specific information discussed here can be represented also symbolically, where any position specific information in any representation is concerned.

Likewise, it is imaginable to represent on the display further information related to the weather which can be obtained via radio. In a particularly refined version the information referring to weather data can be obtained from signals of integrated weather sensors, namely signals from an integrated thermometer, barometer and/or hydrometer.

Furthermore, it is possible that a user with his own information can interact intentionally or arbitrarily with the symbolic representation or animation. Therefore a deterministic or random variation of the representations, hence the content of the information, is possible. To this end, a random generator could be activated and used.

The information represented in animated form can, additionally and optionally, also be represented in alphanumeric or digital form. This mode is understood to be a complement to the animation itself.

In addition to the information mentioned above further information may be displayed on the screen. This further information interacts or can be made to interact with the above mentioned information. To be specific, further information may be information interactively changed in a dialog, e.g. a diary or an address book or a notebook. Equally possible are games, pocket computers, translation guides, help in vital matters, etc.

A particularly favorable type of additional information is representations of characters or comics. The type of character may be selected from a library of different characters. The character traits may be different, freely eligible or even definable.

In addition to the representation of the clock and the representation of the further information, as extensively discussed above, the character could be useful for a graphic and/or tonal presentation or illustration and/or for interaction with the information. For a concrete example of a character, reference is made to the separate description of the figures.

Instead of using the above mentioned character, it is also possible with a suitable interface to load arbitrary representations, e.g. color photographs, in conjunction with other information. These color photographs or information may be represented arbitrarily animated or they may be stored in a protected file for safety reasons of the identification.

The information mentioned here, whatever they are, with respect to the clock first of all on one page representable or on the whole on several pages, depending on the wealth of information.

From the point of view of technical realization it is important to note that the display can be a LCD display which is controlled by an application specific integrated circuit (ASIC). For the realization of a dialog the display might be touchsensitive, therefore being the input medium without further controls.

Likewise, an interface for communication with similar devices, with computers or other peripherals can be implemented for enabling a communication between similar devices on the one hand and for loading information from a computer on the other hand. The other peripherals may be a printer, another monitor, etc.

The interface may be a conventionally cabled one or, very advantageously, an optical interface which facilitates very much the handling.

The overall dimensions of the device could be the size of a notebook or an electronic palmtop. Likewise it is imaginable that with very large scale miniaturization the device is adapted to the size of a wrist, or pocket watch, which would certainly favor the applicability of the device.

Finally, the display might be coverable with a lid fixed by a hinge like a notebook, thereby giving protection to the display and the device.

There are several possibilities to develop and to organize the teaching of the present invention in an advantageous way. For this purpose, reference is made on the one hand to the list of claims following claim 1 and on the other hand to the following description of an embodiment of the invention based on the drawing. In conjunction with the description of the preferred embodiment of the invention, further preferred embodiments and developments of scope and spirit of the invention will be described.

DETAILED DESCRIPTION OF THE INVENTION

Figure 1:
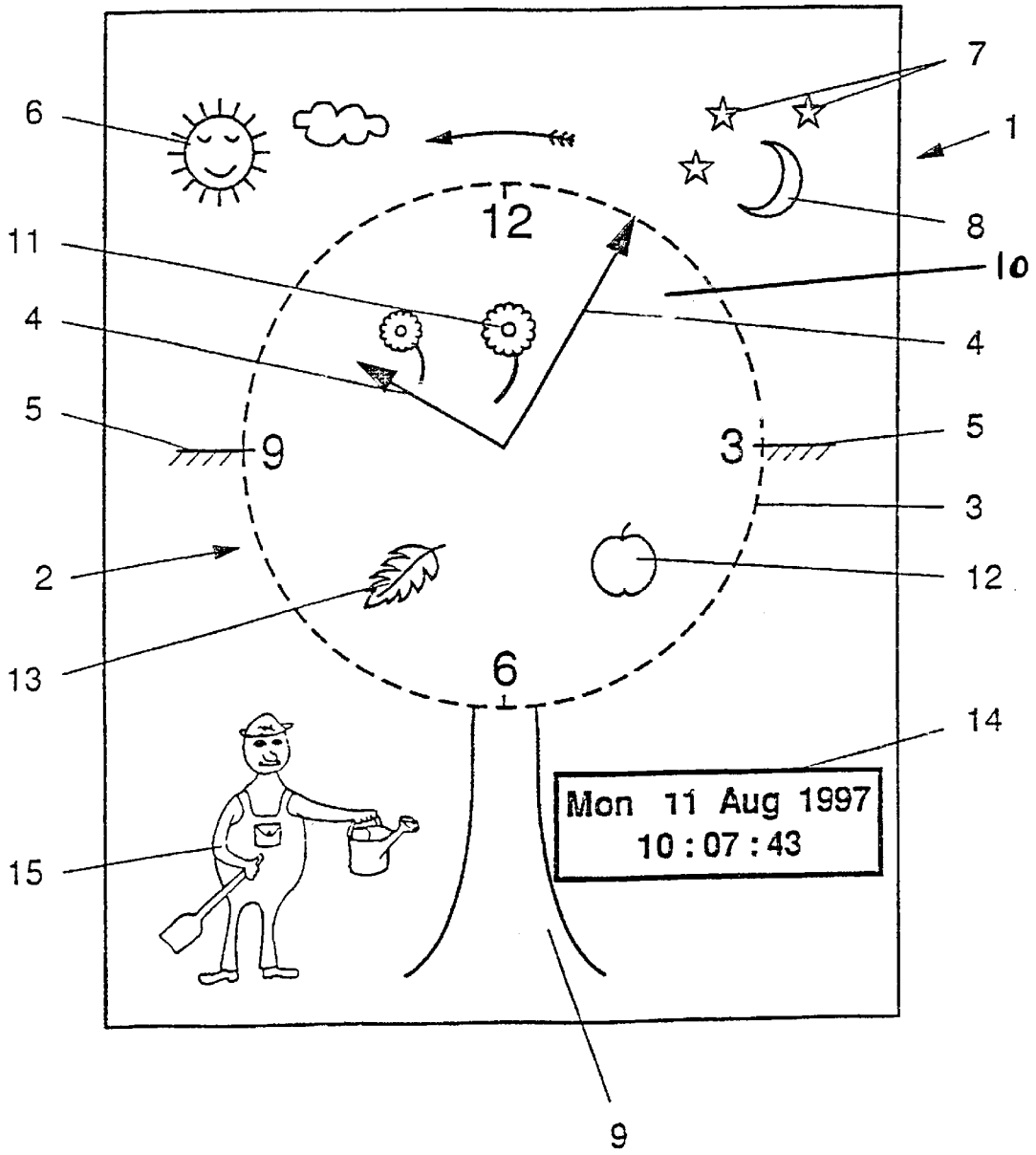
FIG. 1 is a schematic representation of an embodiment of the invention, where different information related to the course of time is depicted simultaneously.
Figure 2:
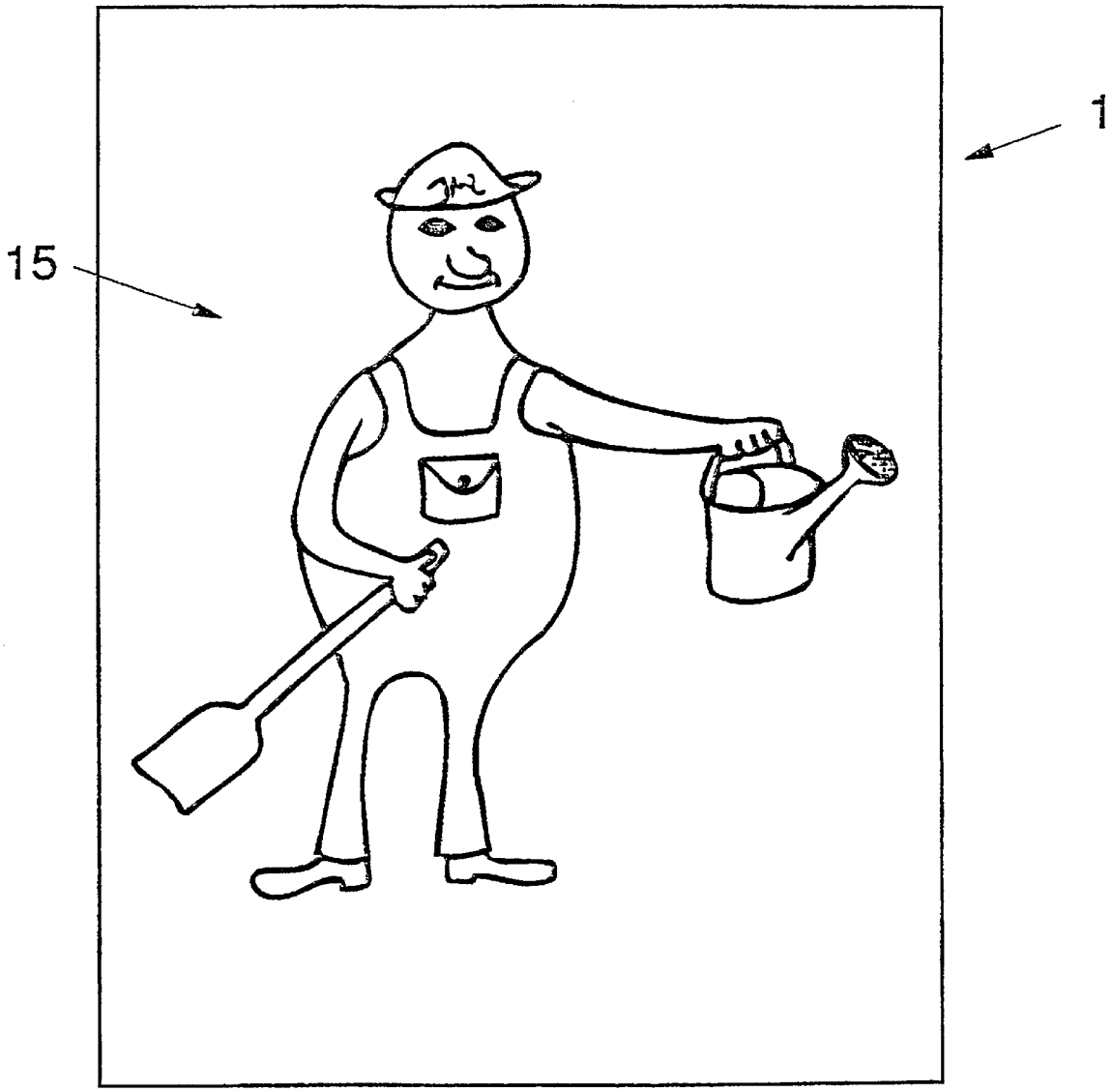
FIG. 2 illustrates an embodiment of the invention where, on another page, further information in form of a character is exhibited.

FIGS. 1 and 2 show the display 1 of an embodiment of the invention of a timepiece with a computer based clock 2, where the representation of the time takes place on the optoelectronic display 1.

According to the invention, on the display 1 further information related to the course of time is shown in continuous variation, i.e. dynamic. The representation of the information is generated with an animation program.

In FIG. 1, representation of time is a circular dial 3 with hands 4 depicted in a continuously variable way. Further information is represented inside as well as outside of the dial 3.

The additional information relates to geographical information on the one hand, namely e.g., the horizon 5, and to information specifically connected to the course of time on the other hand, namely the representation of the sun 6, the stars 7 and the moon 8. In FIG. 1 several informations with respect to the course of time are simultaneously shown which on the display 1 are in reality not simultaneous, at least not in the framework of a "genuine" representation of time.

Finally, the display 1 shows according to the time of day the position of sun and moon, the phase of the moon and the actual position of selected stars or constellations. The horizon 5 serves as orientation in the course of a day.

Furthermore, the information includes the representation of the realtime season with the help of a symbolism that changes in the course of the year. This symbolism comprises in the embodiment shown a tree 9, where in particular the treetop 10 is used for representation of the specific season according to the change with time of the treetop 10 in the course of the year. To avoid repetition, reference is made to the general introduction above.

FIG. 1 shows furthermore, that the rim of the treetop 10 serves simultaneously as dial or dialfield 3 of the clock 2. Objects, typical for the current season, are associated with the treetop 10, e.g., blossoms 11, fruits 12 or leaves 13. Also here a simplified representation was chosen in which the objects appear simultaneously. In a real animation the totality of these objects chosen here cannot, of course, appear at the same time.

FIG. 1 also shows an alphanumeric representation 14 of the otherwise symbolic information. This alphanumeric representation 14 is optional and can be faded out.

Additional information is shown on the display 1, namely information of a figurative type or of a character 15. This character 15 can take on several tasks, e.g., to remind of jobs to be done or to present the illustrated information or to elaborate it. Hence the character serves two purposes: on the one hand he supplements the information which depends on time or location and on the other hand he can take over separate tasks like being advisor or player.

FIG. 2 shows the character 15 in a blown-up view. Clearly, the character 15 changes in the course of the time, since he is dynamically generated by the animation program. It is up to the user to choose whether the character 15 is shown in FIG. 1 (main menu) or separately. The character 15 may be incorporated into the totality of information in a pictorial way.

Figure 3:
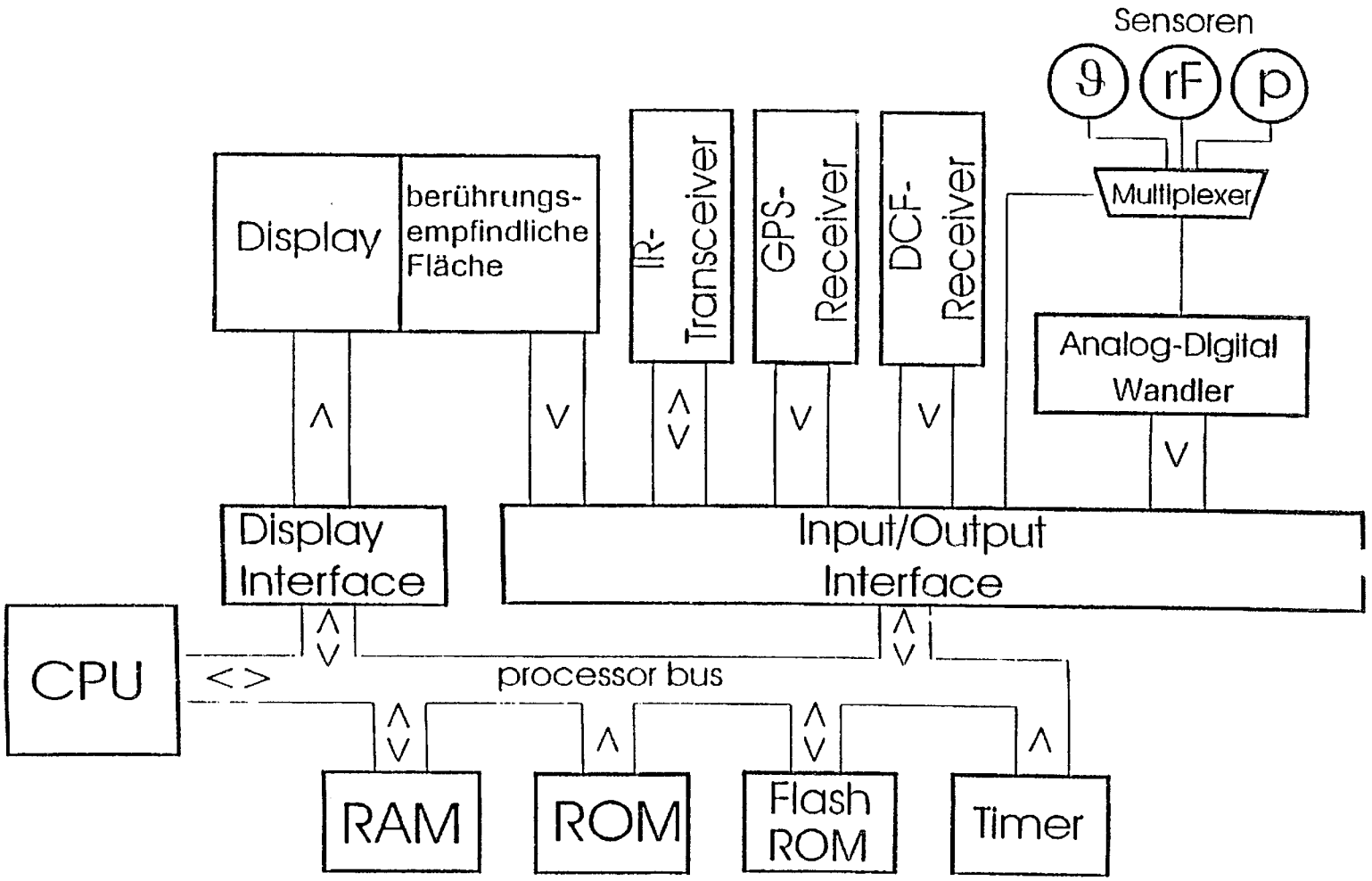
FIG. 3 illustrates the block diagram of the hardware of an embodiment of the invention.

Finally, FIG. 3 shows the main components of the device according to the invention. The block diagrams are as follows:

CPU: The microprocessor controls all components connected with the bus of the system—RAM, ROM, Display, Interface, Input/Output, Flash ROM and Timer—and performs all necessary calculations.

ROM: The operation system of the device (abbreviated TT in the following) is stored in this non-volatile storage and defines the mode of operation of the processor, lay-out and functions of the TT.

FLASH ROM: Data are stored here which personalize the TT and must not be lost in case of interrupt or failure of electric power.

RAM: The remaining data are stored in this storage.

TIMER: A synchronized pulse generator is the internal clock of the system (timing-unit) and can be synchronized with the DCF signal.

DISPLAY: A high resolution color display (typically 100 dpi) is used for the representation of arbitrary animated graphics.

TOUCH SENSITIVE LAYER: This touch sensitive matrix covers the full surface of the screen and is responsive to the user input.

INPUT/OUTPUT INTERFACE: The system bus is connected here with the peripheral components.

DCF-RECEIVER: Serves as receiver for the official time normal.

IR-TRANSCEIVER: Interface for exchange of data with other devices.

GPS-RECEIVER: Used for the determination of position via satellite signals.

SENSORS (theta, rF, p): Used for the measurement of temperature, relative humidity of air and barometric pressure.

MULTIPLEXER: Chooses a sensor for digitalization.

ANALOG-DITIGAL-CONVERTER: Serves for digitalization of analog data.

The present device (called TT in the following) constitutes the invention of a continuously animated, non-static dial of a timepiece, where an animation of the dial is coupled with the seasonable progress of the time. It is equally possible to embed the dial into an animated sky-field, in which celestial objects in correct position and phase are represented, also non-static and following precisely the rhythm of day/night and the monthly pattern. E.g. a quick glance on the TT is sufficient to determine the time of day.

The animation of dial and environment is achieved by using a high resolution LCD screen which is controlled by an application specific integrated circuit (ASIC). By use of state of the art micro- and opto-electronics the TT can operate in a stand-alone mode, i.e. no controls like keys, winders, setting rings etc. are needed.

In the process of development and improvement of the conventional clock—as realized here—the representation of hours and minutes via hands has been kept, because they are adapted to the acquired human sense of orientation in time in an optimum way. The animated (non-static) dial of the TT, however, is represented by a circular treetop, because hereby the conventional marks for the hours 3, 6, 9, 12 can be kept, whereas in the interior of the treetop objects, typical for the current season, are waxing and waning. A different embodiment of the dial, e.g. a form of a wheel, would be possible as well.

The device according to the invention or the concept on which the TT is based may be characterized in the following way:

The TT is the logical development of the conventional clock.

The TT is user friendly, since it needs no special controls.

The TT is an esthetically appealing, artful object (LCD-art).

The TT is entertaining and instructive, as well as immediately intuitively appealing.

The TT uses an animated symbolism for the representation of the changing time and the symbolism is taken from human environment.

The TT can be built in a large variety of models. This variety is made accessible to the user with a simple dialog.

In the following, reference is made again to FIGS. 1 and 2 with respect to a specific embodiment.

FIG. 1 shows a possible realization of the TT in life-size (DIN-A7, 10.5 cm×7, 5 cm). The TT is activated, whenever a covering lid attached with a hinge at the left side is opened up (not shown). A slim man-made pencil (stylo) sticks in a slot on the right side of the TT. Its function will be explained later.

The depiction in FIG. 1 including the full date in the box next to the trunk is usually not seen at switching on the TT. The TT is coated with a high resolution liquid crystal display (LCD) which is colored and touchsensitive with a resolution of around 100 dpi. Bright pointers being full of contrast represent the hour and minute hands of a clock which are synchronized with a DCF timing signal. The quality of the display is to be optimized such that the clock has a natural appearance and the individual pixels are undetectable by the eye. The treetop is the dial of the clock.

A microcomputer operates in the background which has access to the time of day, date and position, viz. repositioning of the device. With this information, the positions of sun, moon and stars can be determined and be represented. According to the actual season, an animation program develops various manifestations of a tree in the course of the year. Naked boughs in winter, blossoms in spring and fruits in fall. These objects are indicated in FIG. 1 symbolically. Clearly, there is only one category of objects in each season.

The growth and decay of the symbols is controlled via deterministic, randomized or fractal algorithms. Also the other objects on the display undergo a slow but steady change.

Further, a horizon is drawn behind the tree. The sky-field is located above the horizon. Sun, moon, stars and clouds can be visualized there. In the animation, e.g. the sun rises in realtime with red sky in the morning from the east (right-hand side of the tree, corresponding to 3 o'clock on the dial), then moves to the west in the course of the day and sets finally on the left side, possibly again with red sky. Analogous provisions are made for the appearance of the moon and the most important constellations at night, and the phases of the moon. The necessary astronomical computations are performed by a microprocessor and realistic representations of the celestial objects are possible. Clouds appear, whenever the TT has access to corresponding weather data.

For additional tasks, the whole touchsensitive LC-display can be used as input medium. It is only necessary to use the finger or the stylo mentioned above for pressing on pictograms or well defined regions of the display (e.g. sky or trunk) or text oriented menus. For aiding the memory, some important pictograms may be given on the inside of the covering lid. In case the user wishes a precise date, some particular symbol may be touched yielding, e.g. FRIDAY, Jan. 1, 1997 14:51:38".

Also a naive observer will consider the TT an appealing device for representation of time, heavenly bodies and seasons. It is important to note that this "clock" needs no attendance whatsoever, as far as other aspects like weather or change of location are disregarded.

Another important feature of the TT is the animation of the screen. The display appears to be alive due to the continuous small changes, although it is not apparent what exactly is being changed at the particular moment. However, the display changes dramatically in case of jet-travel, and long-haul journeys are being undertaken by every third of the population once per year on the statistical average. In principle, the current position and elevation of the device above sea level could be determined automatically via satellite (GPS, SPS, PPS systems).

In a fast and simple way the TT can be supplied with data on repositioning in an aircraft or at its arrival via software-dialog. The drastic change to the representation of the tree mentioned above would take place, e.g. at crossing the equator. For example, during a flight from Hamburg to Capetown fruits in fall disappear within several hours and are replaced by freely grown blossoms in spring. On flights with a change of meridian the new timing zones are readjusted. And during a summer vacation in Lapland there is no sunset at all.

In order to enlarge or modify the market for the TT, we have chosen for the present embodiment of the device a comic type character, namely the representation of Joe the weatherman or Joe the attendant. This comic type representation is shown in the example of FIG. 1, where Joe is displayed in activities close to the trunk of the tree. Joe should be a well defined "character", e.g. a friendly attendant, middle-aged and dressed in green overalls, moving around the trunk with distinct gestures and tools. Joe is good natured and endearing and designed in such a way as to create a pet or caretaking relationship with many users. In this content, reference is made to the big commercial success of Tamagotchi's egg from which the TT stands out because of its careful animation and the quality of the representation. Joe could give the weather forecast or could bet with the user on the development of the weather in the days to come. Joe keeps on surprising with unexpected actions, e.g. watering the tree or taking forty winks. In case of bad treatment Joe could show his displeasure, e.g. if his wish for weather data is not met with (not indoors and not in blazing sunshine). If things are carried too far for him, he starts sawing into the tree.

The character Joe is provided for as an option for two reasons:

- anyone interested in the TT is not necessarily interested in a comic-type character
- the animation of the comic-type character complicates the development of the software for the TT.

It is possible, however, that a comic-type character like Joe is advantageous for the device according to the invention, since the animation can show Joe performing various functions (assistant, animator, book-keeper etc.) in various styles. The animation can be designed as a comic strip or as a trick film.

In addition to the functions mentioned above, the device according to the invention, i.e., the TT, might contain many more useful functions, to be defined arbitrarily. Different pages of the TT may be addressed by touching the display or some keys with the finger or the stylo. Thus Joe could accompany the owner on his way to the various functions of the TT and could provide sufficient illustrations to help the inexperienced user to operate the device intuitively in a correct manner. The multitude of possible functions is hard to enumerate fully. It is important in any case that the selection used suits the character of the owner. Example given, the workaholic may get a notebook with alarm function, the person interested in parapsychology may get his personal horoscope etc.

FIGS. 1 and 2 show only two pages of the device according to the invention. Further informations on additional pages of the device may comprise, in a most advantageous way, the following pages, e.g.:

- first page: the "cover page" (according to FIG. 1) with tree, clock, celestial bodies and elements of the seasons
- second page: separate representation of the comic character (according to FIG. 2)
- third page: weather station with weather forecast
- forth page: diary
- fifth page: notebook
- sixth page: games like Tetris or Mahjong
- seventh page: personalized time representations (countdown), birthdays, personal data, picture of long-time companion
- eighth page: personal daily horoscope
- ninth page: therapies (abuse of smoking or drinking etc; diet)
- tenth page: dictionary (e.g. German-English)
- eleventh page: pocket computer, etc.

Finally, the communication of the TT with other devices is to be mentioned, e.g. with a traditional personal computer, with remote controls, with sensors, even with digital cameras. By use of an optical interface, the TT may be personalized for the first time after the purchase by the dealer or by the client. This means that the personal data of the owner are stored in the TT and cannot be changed by an unauthorized third party. In this way the device will become a unique specimen and will be of no interest for thieves or fences. In the case that the storage capacity of the device is not sufficient for all possible functions, it is possible to store into the storage of the TT a special selection made by the user. A synchronization of appointments and addresses with the own PC is obviously possible. If the owners of two TT's get to know each other, the exchange of "electronic visiting cards" is possible without any problem in a few seconds. It is also possible to load software updates or software variations into the TT later on.

What is claimed is:

1. A timepiece with a computer based clock, wherein the representation of time takes place on an optoelectronic display in an analog way, and wherein on the display additional information concerning the course of time and comprising the realtime season is represented by a symbolism which changes in the course of the year in a dynamic and continuous variation by means of an animation program.

2. Device according to claim 1, characterized such that for the representation of time a circular dial-field with hand is shown in a fashion which is continuously variable.

3. Device according to claim 2, characterized such that the information is shown outside the dial-field.

4. Device according to claim 3, characterized such that the information is assigned in its position to the numbers.

5. Device according to claim 2, wherein the display is rectangular, characterized such that the information is assigned to the border regions of the display.

6. Device according to claim 2, characterized such that the information is shown inside the dial-field.

7. Device according to claim 1, characterized such that the information comprises the representation of the course of day.

8. Device according to claim 1, characterized such that the information comprises the representation of a horizon with sky positioned above it.

9. Device according the claim 1, characterized such that the information comprises the representation of sun, stars, moon and clouds.

10. Device according to claim 1, characterized such that the information comprises the realtime position of the sun.

11. Device according to claim 1, characterized such that the information comprises the realtime position of the moon and the phase of the moon.

12. Device according to claim 1, characterized such that the information comprises the realtime position of selected stars and constellations.

13. The timepiece of claim 1 wherein the display is touchsensitive and serves as an input means.

14. The timepiece of claim 1 wherein the information can be represented on a plurality of pages.

15. The timepiece of claim 1 wherein the symbolism includes tree leaves, fruit, and precipitation.

16. Device according to claim 1, characterized such that the symbolism is a tree or a circular treetop.

17. Device according to claim 16, characterized such that the borderline of the treetop constitutes simultaneously the dial of the clock.

18. Device according to claim 16, characterized such that the realization of objects typical for the season are assigned to the tree or the treetop.

19. Device according to claim 1, characterized such that the information concerning the course of time is preferably controlled by DCF signals.

20. Device according to claim 1, characterized such that the information concerning the course of time is controlled via position recognition being fully automatic and using GPS signals.

* * * * *

UNITED STATES PATENT AND TRADEMARK OFFICE

CERTIFICATE OF CORRECTION

PATENT NO. : 6,449,219 B1
DATED : September 10, 2002
INVENTOR(S) : Hepp et al.

It is certified that error appears in the above-identified patent and that said Letters Patent is hereby corrected as shown below:

Title page,
Item [56], References Cited, FOREIGN PATENT DOCUMENTS,
"628 042" should read -- 627,042 --.

Signed and Sealed this

Fourth Day of February, 2003

JAMES E. ROGAN
*Director of the United States Patent and Trademark Office*